United States Patent [19]

Nixon

[11] Patent Number: 4,611,687

[45] Date of Patent: Sep. 16, 1986

[54] THREE-FUNCTION ACOUSTICAL PANEL

[76] Inventor: Michael T. Nixon, 2810 N. Urbandale La., Plymouth, Minn. 55447

[21] Appl. No.: 758,120

[22] Filed: Jul. 23, 1985

[51] Int. Cl.[4] ..... E04B 1/82

[52] U.S. Cl. ..... 181/286; 181/288; 181/290

[58] Field of Search ..... 181/200, 201, 204, 287, 181/288, 290, 291, 286

[56] References Cited

U.S. PATENT DOCUMENTS

| | | | |
|---|---|---|---|
| 2,271,929 | 2/1942 | Venzie . | |
| 2,410,413 | 11/1946 | Hurley . | |
| 2,944,622 | 7/1960 | Dobbins . | |
| 3,247,928 | 4/1966 | Poncet | 181/287 |
| 3,651,887 | 3/1972 | Eckel . | |
| 3,934,382 | 1/1976 | Gartung | 52/144 |
| 4,042,061 | 8/1977 | Murakami | 181/210 |
| 4,170,674 | 10/1979 | Matsuki | 181/292 X |
| 4,242,391 | 1/1981 | Reinhardt et al. | 181/284 X |
| 4,397,894 | 8/1983 | Haines, Jr. et al. | 181/293 X |
| 4,487,793 | 12/1984 | Haines, Jr. et al. | 181/290 X |
| 4,522,165 | 6/1985 | Ogawa | 181/204 X |

*Primary Examiner*—Benjamin R. Fuller

*Attorney, Agent, or Firm*—Orrin M. Haugen; Thomas J. Nikolai

[57] ABSTRACT

Described is an acoustical panel to control sound emissions in facilities requiring sanitary conditions. The panel incorporates a moisture proof outer shell, one or more air pockets and a woven inner core. The panel controls sound through transmission, absorption and dispersion.

17 Claims, 3 Drawing Figures

THREE-FUNCTION ACOUSTICAL PANEL

BACKGROUND OF THE INVENTION

The present invention relates to acoustical panels and more particularly to an acoustical panel suitable for use in facilities which require a high degree of sanitary control. Such facilities include food processing plants, bottling and beverage plants, dairies, bakeries, meat and poultry plants, pharmaceutical and medical equipment facilities as well as electronic component and semiconductor manufacturing facilities. It is well known that people who work in facilities of the type described above are exposed routinely to hazardous noise levels. Past efforts to effectively control noise levels in such facilities have been thwarted to a large extent because conventional acoustical materials are either not sufficiently durable to permit their use in an industrial environment or not able to meet the sanitary requirements for such plants. In addition, the walls, floors and ceilings of such facilities must be smooth and hard for easy cleaning. Such surfaces raise the ambient noise levels generated by machinery and the like through the reflection of the sound waves generated in the plant.

Several types of easily cleaned acoustical panels which have proven to be useful to control sound emissions are described in applicant's co-pending U.S. patent application Ser. No. 572,466, filed Jan. 20, 1984. The acoustical panels described in the co-pending application generally involve the encapsulation of fiberglass along with one or more other materials in a durable plastic. These panels have proven to be durable and easily washable. They have also proven to be satisfactory from an acoustical standpoint. These panels achieve their acoustical performance through sound absorption and sound transmission.

SUMMARY OF THE INVENTION

The present invention comprises an inexpensive and durable acoustical panel having a stiff vinyl shell. The invention is suited for use in clean room facilities found in food processing plants, medical equipment manufacturing plants as well as plants where electronic components are made. It is also well suited for areas in which chemical solvents and the like are used because it is easily cleaned and its exterior is constructed out of materials which are not effectd by most solvents. Other applications are also appropriate for the invention.

Various advantages and features of novelty which characterize the invention are pointed out with particularity in the claims annexed hereto and forming a part thereof. However, for a better understanding of the invention, its advantages, and the objects attained by its use, reference should be had to the drawings which form a further part hereof, and to the accompanying descriptive matter, in which there are illustrated and described certain preferred embodiments of the invention.

BRIEF DESCRIPTION OF THE DRAWINGS

In the drawings, in which like reference numerals identify the various elements throughout the several views.

DESCRIPTION OF THE PREFERRED EMBODIMENT

Figure 1:
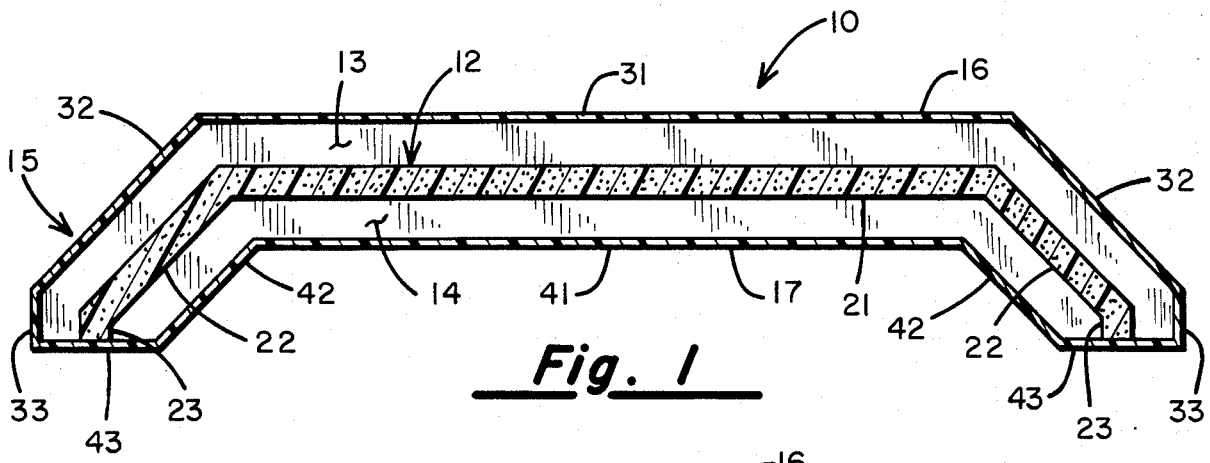
FIG. 1 is a cross-sectional view of the preferred embodiment of the invention intended to show the interior construction.

Referring now to FIG. 1, an acoustical panel 10 accoring to the invention is shown to comprise an inner core 12, air pockets 13 and 14 on either side of inner core 12 and an outer shell 15.

The inner core 12 is comprised of a woven, sound absorbing. fibrous material which is preferably fiberglass. In the preferred embodiment, the inner core is molded to provide a square or rectangular shaped center section 21, four trapezoidal shaped side sections 22, and four rectangular shaped foot sections 23. As shown in FIG. 1, the side sections 22 each project from a side of the center section 21 at approximately at 45° angle. Further, associated with each side section 22 is a foot section 23. The foot sections 23 project from the side sections 22 at approximately a 45° angle so that the plane of each foot section 23 is roughly perpendicular to the plane of the center section 21.

The inner core can be of any desired size or shape. Preferably, however, it is of uniform thickness and dimension so that the panel 10 will fit into a standard 2'×2' or 2'×4' T-bar suspension grid.

Figure 2:
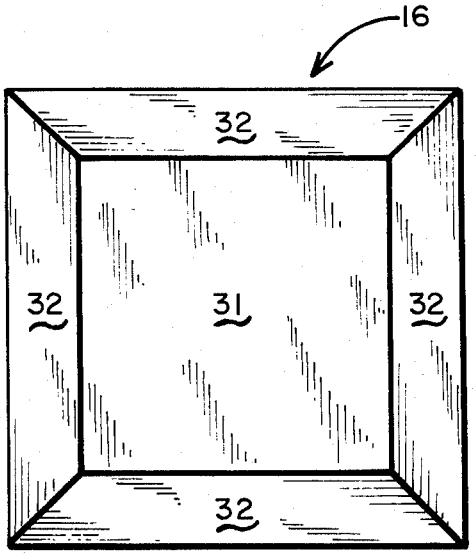
FIG. 2 is a view of the back of the preferred embodiment.
Figure 3:
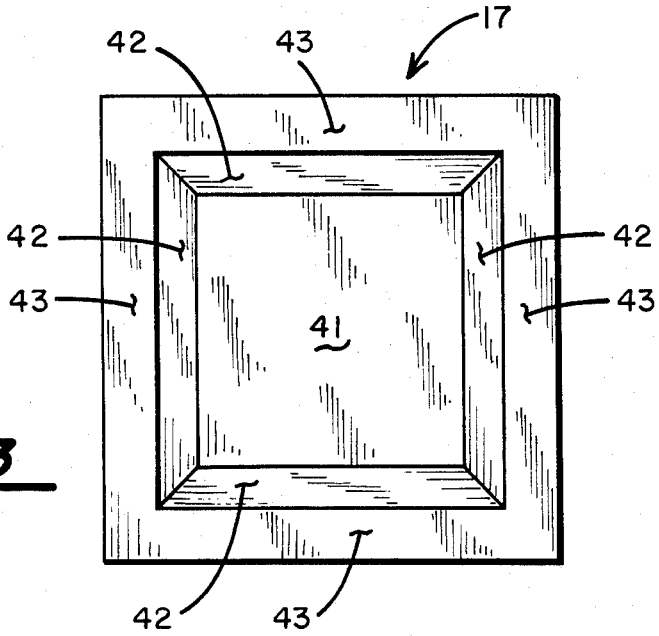
FIG. 3 is a view showing the front of the preferred embodiment.

FIGS. 2 and 3 describe the back section 16 and the front section 17 of the outer shell 15.

Referring now to FIG. 2 which shows the back 16 of the panel, it too has a rectangular or square shaped center section 31 and four trapezoidal shaped side sections 32. The trapezoidal shaped side sections 32 project from the center section at roughly a 45° angle. Not shown in FIG. 2 but also present are four rectangular leg sections 33 (see FIG. 1) which project from the longest edge of each of the trapezoidal shaped side sections 32 at 45° angle so that the plane of each leg section 33 is roughly perpendicular to the center section 31. All parts of FIG. 2 are preferably constructed out of a solid, stiff vinyl plastic product.

As stated above, FIG. 3 shows the front 17 of the panel. The center portion 41 of the front of the panel again has a rectangular or square shape. The panel front also has four trapezoidal shaped side sections 42 and four trapezoidal shaped base sections 43. Projecting outwardly from the center portion 41 at approximately a 45° angle are the four side sections 42. Projecting outwardly from each of the side sections at approximately a 45° angle are base sections 43. In this configuration, the plane of the base sections 43 is parallel to the plane of the center section.

One skilled in the art will readily recognize that the front and back sections of the outer casing of the panel can be joined together in any one of a number of ways. Preferably, however, the front and back sections will be molded so they can snap together or so that they can be secured together by an adhesive. When assembled, the outer shell 15 should fully encapsulate the inner core so none of the fibers can escape contaminating the atmosphere. Also, the outer shell 15 should be impervious to moisture and gases so the inner core does not become wet and rot.

To construct the panel, the inner core 12 is placed upon the front section of the shell 15 in a configuration such as shown in FIG. 1. The back portion of the outer shell is then secured into place so that the inner core 12 is fully encapsulated by the outer shell 15. The design is such that the center sections 21, 31 and 41 of the core 12, the back 16 and the front 17 are spaced from and approximately parallel to each other. The same is true for the side sections 22, 32 and 42 of the core 12, back 16 and front 17. An air pocket 18 naturally forms between the back 16 and the core 12. A similar air pocket 19 forms between the core 12 and the front 17 on the interior of the shell 15.

The primary purpose of the outer shell 15 is to contain the sound absorbing materials of the inner core 12. It must be highly durable, washable and steam cleanable. Further, it must not interfere with the sound absorbing characteristics of the inner core 12. The outer shell 15 also should be impervious to common solvents, acids, greases and other chemicals. Those skilled in the art will recognize that any one of a number of stiff vinyl material would be suitable.

When in use, one or more of the panels are supported within a suspension T-grid. As sound waves strike the front 17 of the panel, vibration of the surface material results which reduces the acoustical energy that is reflected. The vibration also causes the sound energy to be transmitted into the panel where it can be absorbed by the loosely woven fabric of the inner core 12. Because the inner core 12 is suspended, for the most part, above the front 17 of the outer shell 15, its presence does not interfere with the vibrations necessary to achieve effective acoustical performance. The shape of the front section 17 of the panel should also be designed to improve acoustical performance by diffusing sound energy. A panel with no angles tends to reflect the sound.

I claim

1. An acoustical panel comprised of:

(a) an inner core fabricated of a woven fiberous material having a center section and a plurality of side sections;

(b) an outer shell which is impermeable to moisture and air and which has a back portion and a front portion, said front portion including a center section associated and in general parallel relationship with the center section of the inner core, said front portion further including a plurality of side sections each of which is associated with a different side section of the inner core and generally parallel thereto;

(c) a pocket separating the center and side sections of the inner core from the center and side sections of the front portion of the outer shell.

2. The acoustical panel of claim 1 wherein the inner core is fiberglass.

3. The acoustical panel of claim 2 wherein the density of the inner core is 13.5 pounds per cubic foot.

4. The acoustical panel of claim 1 wherein the woven fibrous material is molded fiberglass.

5. The acoustical panel of claim 1 wherein the shell is constructed of generally rigid vinyl plastic.

6. The acoustical panel of claim 1 also including means for joining the front and back portion of the shell together.

7. The acoustical panel of claim 6 wherein the front portion of the outer shell further includes a base section associated with each side section.

8. The acoustical panel of claim 7 wherein the center section and base sections are located on planes generally paralell to each other and the side section is located on a plane which is neither parallel nor perpendicular to said planes.

9. The apparatus of claim 8 further including a second pocket between the inner core and back portion of the outer shell.

10. The acoustical panel of claim 9 wherein the inner core is fiberglass.

11. The acoustical panel of claim 10 wherein the inner core has a density of 13.5 pounds per cubic foot.

12. The acoustical panel of claim 10 wherein the inner core is molded fiberglass.

13. The acoustical panel of claim 12 wherein said outer shell is constructed of generally rigid vinyl plastic.

14. The acoustical panel of claim 13 also including means for joining said front portion and back portion of the outer shell together.

15. The acoustical panel of claim 14 wherein said front portion of the outer shell further includes a base section associated with each side section.

16. The acoustical panel of claim 15 wherein the center section and the base sections are on planes generally parallel to each other and the side sections are juxtaposed between its associated base section and the center section along a plane which is not parallel or perpendicular to the plane of the center section or the plane of the associated base section.

17. An acoustical panel comprised of:

(a) an inner core fabricated of molded fiberglass having a center section and at least one side section;

(b) a rigid outer shell impermeable to moisture and air and having an integrally molded front portion, an integrally molded back portion, and means for joining the front portion and back portion together; said front portion comprised of a center section, at least one side section and a base section associated with each side section, each base section and the center section located on planes generally parallel to each other and the side section located on a plane which is neither parallel nor perpendicular to the planes of the base and center sections; said back portion including a center section and a plurality of side sections;

(c) a first pocket between the inner core and the front portion of the shell; and (d) a second pocket between the inner core and the back portion of the shell.

* * * * *

UNITED STATES PATENT AND TRADEMARK OFFICE

CERTIFICATE OF CORRECTION

PATENT NO. : 4,611,687

DATED : September 16, 1986

INVENTOR(S) : Michael T. Nixon

It is certified that error appears in the above-identified patent and that said Letters Patent are hereby corrected as shown below:

Column 4, Line 6, "6" should read -- 1 --.

Column 4, Line 11, "paralell" should read -- parallel --.

Column 4, Line 14, "8" should read -- 1 --.

Column 4, Line 19, "10" should read -- 9 --.

Column 4, Line 23, "12" should read -- 9 --.

Column 4, Line 26, "13" should read -- 9 --.

Column 4, Line 29, "14" should read -- 9 --.

Signed and Sealed this

Twenty-fifth Day of November, 1986

*Attest:*

DONALD J. QUIGG

*Attesting Officer* *Commissioner of Patents and Trademarks*